United States Patent [19]

Barkan et al.

[11] Patent Number: 4,645,888

[45] Date of Patent: Feb. 24, 1987

[54] LOAD BREAK SWITCH WITH SAFETY MECHANISM

[75] Inventors: Philip Barkan; David S. Gere, both of Stanford, Calif.

[73] Assignee: Raychem Corporation, Menlo Park, Calif.

[21] Appl. No.: 810,882

[22] Filed: Dec. 17, 1985

Related U.S. Application Data

[63] Continuation of Ser. No. 598,558, Apr. 9, 1984, abandoned.

[51] Int. Cl.[4] ..... H01H 33/40; H01H 33/54

[52] U.S. Cl. ..... 200/83 W; 200/148 A; 200/148 R

[58] Field of Search ..... 200/148 R, 148 A, 144 B, 200/145, 83 W

[56] References Cited

U.S. PATENT DOCUMENTS

| | | | |
|---|---|---|---|
| 2,137,880 | 11/1938 | Loesser . | |
| 2,419,074 | 4/1947 | Herbert . | |
| 2,454,340 | 11/1948 | Reichel . | |
| 2,742,548 | 4/1956 | Cole | 200/302.3 |
| 2,794,931 | 6/1957 | Gardner . | |
| 2,860,933 | 11/1958 | Wolff . | |
| 2,941,407 | 6/1960 | Huber et al. . | |
| 3,114,815 | 12/1963 | Easley et al. | 200/148 A |
| 3,422,680 | 1/1969 | Nolte | 200/83 W |
| 3,742,165 | 6/1973 | Hellman | 200/83 W |
| 4,020,307 | 4/1977 | Strubin | 200/302 |
| 4,153,827 | 5/1979 | Mircovich et al. | 200/144 B |
| 4,236,054 | 11/1980 | Karrenbauer et al. | 200/145 |

*Primary Examiner*—Robert S. Macon

*Attorney, Agent, or Firm*—Edith A. Rice; Herbert G. Burkard

[57] ABSTRACT

A single-phase ground enclosed load break switch for distribution voltages has a hermetically sealed cylindrical metal housing of from 2 to 6 inches diameter which contains an insulating gas under pressure. The switch has a movable contact assembly to contact a pair of opposed stationary coaxial conductors within the housing. A rocking bellows at the fulcrum of a crank actuator provides a compact hermetic seal for the actuator without excessive strain of the bellows. A safety interlock with a visual indicator locks the contact assembly in case of a loss of pressure. Excessive pressure in the switch causes the bellows to be punctured with consequent locking of the contact assembly. The switch is small enough to be mounted directly on a transformer or placed into a cable, without the need for a separate enclosure.

11 Claims, 6 Drawing Figures

LOAD BREAK SWITCH WITH SAFETY MECHANISM

This application is a continuation of application Ser. No. 598,558, filed Apr. 9, 1984, now abandoned.

CROSS-REFERENCES

This application contains subject matter also disclosed in application Ser. No. 598,556 filed Apr. 9, 1984.

BACKGROUND

This invention relates to safety features for switches, and particularly for ground enclosed, load-break switches adapted for use in medium voltage power distribution systems in the range about 1 to about 36 kilovolts (kv) for interrupting currents of up to about 1 kiloampere (ka).

Load break switches used in medium voltage power distribution range circuits generally include a pair of electrodes, one being stationary and the other movable to open and close the circuit. As commonly used in three-phase systems, three or multiples of three switches are mounted in a common grounded metal enclosure.

One type of load break switch for power distribution systems is gas insulated switches that employ a gas for both insulation and interruption. Sulfur hexafluoride ($SF_6$), either alone or mixed with other gases such as nitrogen, is used. The gas is used to rapidly extinguish the arc formed as the switch is opened. In a typical three phase configuration, a grounded metal enclosure surrounds three, or multiples of three, switches. Each individual switch typically comprises an unsealed cylindrical housing of a plastic such as reinforced epoxy resin. A grounded metal housing filled with sulfur hexafluoride surrounds the interrupters with substantial clearance to prevent arcing.

A problem with pressurized gas filled switches is that the pressure within the enclosure can degrade to an unsafe level at which the arc developed upon opening the switch might not be quenched, resulting in rapid heating and vaporization of the contacts, and in some instances, an explosion. A pressure gage can be provided, but this does not prevent opening the switch and it constitutes an additional source of leakage.

An additional problem with sealed switches is that a malfunction within the switch can cause uncontrolled arcing, heating and consequent vaporization of metalic contacts. This increases the internal pressure of the switch and creates a safety hazard of a possible explosion of the switch.

In view of these problems, there is a need for a pressurized switch that is not a safety hazard when the gas pressure within the switch is either too high or too low and does not incorporate unnecessary sources of leakage.

SUMMARY

The present invention is directed to a switch that satisfies this need. The switch comprises a sealed housing containing a pressurized, insulating gas. A bellows is sealingly mounted to the housing and an actuating arm is sealingly mounted to the bellows and extends into the housing through the bellows. The actuating arm has an operative position in which it is capable of opening and closing the switch.

A low pressure safety mechanism comprises low pressure biasing means such as a spring for biasing the bellows in opposition to gas pressure within the housing. As long as the force of the gas on the bellows is greater than the force of the low pressure biasing means on the bellows so that the bellows is not contracted, the arm remains in its operative position. Locking means are provided to render the arm inoperable. The locking means are positioned so that when the force of the low pressure biasing means on the bellows is greater than the force of the gas on the bellows, the bellows is contracted, and the arm is moved into engagement with the locking means. In this locked position, preferably the arm cannot be moved to either open or close the switch. This prevents the operator from moving the arm, thereby creating an arc, when there is inadequate gas pressure within the housing for quenching an arc. Thus the single bellows provides a seal for motion of the arm opening and closing the switch as well as for motion operating a pressure safety mechanism.

The high pressure safety mechanism of the present invention cleverly takes advantage of features of the low pressure mechanism. The high pressure mechanism comprises a high pressure biasing means that acts on the bellows in opposition to gas pressure within the housing for preventing expansion of the bellows unless the gas pressure increases above a predetermined high level. When the force of the gas pressure on the bellows is greater than the force of the high pressure biasing means on the bellows, the bellows is expanded, and engages puncture means that pierce the bellows. This reduces the gas pressure in the housing so that the low pressure safety mechanism takes effect and moves the arm into the locked position, so that the switch can be neither opened nor closed.

Preferably the bellows deflects in rocking mode when the arm opens and closes the switch.

Preferably the switch includes a pressure indicator so the operator can know whether the switch is operative or is at too low pressure. This indicator can comprise a cover over the actuating arm, and a normal pressure indicia and a low pressure indicia on the arm at a position on the arm external of the bellows. The normal pressure indicia is closer to the bellows than is the low pressure indicia. The cover includes a window so that only one of the pressure indicia is visible at a time. When the arm is in its operative position, the normal pressure indicia can be seen through the window. When the arm is in its locked position, only the low pressure indicia is visible through the window. This alerts the operator that the switch needs to be replaced or repaired.

Thus, according to the present invention, a switch is provided that alerts the operator when the switch is unsafe to use, and also prevents the operator from moving the contacts when the gas pressure within the switch is too low to too high.

DRAWINGS

These and other features, aspects, and advantages of the present invention will become better understood with reference to the following description, appended claims, and accompanying drawings where:

DESCRIPTION

Figure 1:
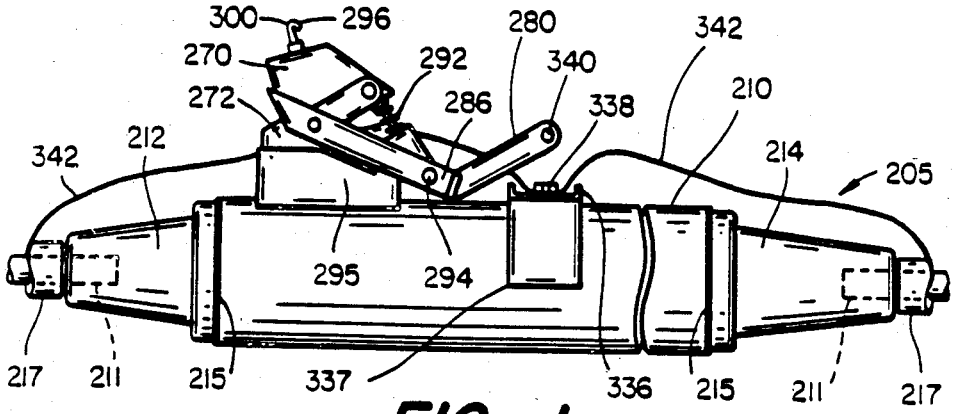
FIG. 1 is a side elevation view of a switch having features of the present invention, the switch including a contact assembly and an actuator.

The present invention is directed to a switch in which a pressurized gas is used. However, it is particularly adapted for the switch shown in FIGS. 1–6, and particularly load-break switches used in medium voltage power distribution systems in the range of about 1 to about 36 kilovolts for interrupting currents of up to about 1 kiloampere. Thus, although the present invention will be described in considerable detail with regard to such a switch, it is to be appreciated that the present safety mechanism can be used with other switches.

The switch shown in the figure is in a grounded enclosure comprising a metal housing of a generally cylindrical configuration. The term "generally cylindrical" is used herein to mean that the housing is substantially cylindrical but not necessarily of circular cross-section. Although less preferred, oval and similar cross-sections can be employed, if desired. The housing can be grounded by connecting it by an appropriate conductor to ground. The housing is hermetically sealed and thus is gas-tight, as well as submersible in water without damage. This makes the switch suitable for underground applications where flooding is a possibility or in environments not compatible with air insulation. In this specification, a hermetic seal is defined as a gas-tight seal effective to limit the total leakage from a pressurized enclosure into the atmosphere to less than $10^{-6}$ cc/sec measured at atmospheric pressure.

The switch contains within the housing an insulating gas maintained under positive pressure, i.e. greater than 1 atmosphere absolute. The gas is preferably sulfur hexafluoride (also referred to herein as $SF_6$). The gas pressure utilized in a particular switch depends on the voltage and current ranges of the switch, its size and the presence of a puffer mechanism, or other gas blast device used. The gas pressure is in the range of greater than 1 atmosphere to about 5 atmospheres absolute, and preferably from about 1.5 to about 5 atmospheres absolute, for $SF_6$ insulated switches in the 15–36 kV range. There is normally a substantial range of safe operating pressure in a given application of the switch. The hermetically sealed housing permits pressures in this range to be maintained for periods in excess of twenty years.

A pair of bushings are mounted in the housing. Each bushing comprises a metal conductor within and protruding through an insulator, i.e. a plastic such as epoxy or a ceramic material. A metal mounting flange is molded into the plastic and is welded to the wall of the ground enclosure of the switch. The metal conductor of the bushing extends through the bushing for conducting electricity into the switch. The conductor can be a rod of a suitable metal, generally copper or aluminum. Where aluminum is used, preferably the aluminum extension is enclosed where the contacts engage in a metal more appropriate for arcing or sliding contact.

Preferably bushings are installed coaxially at the ends of the substantially cylindrical housing with the bushing conductors extending axially through the housing end. This permits an inline circuit configuration not requiring power cable loops and allows a small diameter housing suitable for high levels of pressurization to be used.

The interruption of high power circuits requires the dissipation of substantial amounts of heat by the switch. The primary mode of heat dissipation is by conduction from the switch contacts through the conductors to the external power cable. Secondarily, heat is conducted from the conductors through the bushings into the housing. It is important, therefor, to keep the length of the conductors short. The inner length of the conductor, i.e. that portion of the conductor extending into the body of the switch, depends primarily on the contact stroke used. The conductors must be sufficiently long to make physical and electrical contact with the contact assembly when it is in its first, or closed, position and must accommodate the movement of the contact assembly into its second or fully open position. The additional length of the conductor within the portions of the bushings internal to the housing depends upon the surface distance required along the insulating material of the bushings to prevent arcing to the housing. Because the insulating gas within the housing can be maintained at high pressure, both a short contact stroke and a short internal bushing length can be used.

The contact assembly is capable of assuming a first position in which it is physically and electrically connected with the conductors of each bushing. In this first closed position, the contacts of the assembly must be capable of carrying continuous current. According to its rating, the switch is capable of conducting continuous current up to at least 200 amperes in the lowest rating and up to at least 1000 amps (or 1 kA) and possibly higher. The contact assembly is also capable of assuming a second position in which it is separated from a first conductor of one of the bushings to interpose a gas insulated gap in the circuit path thereby interrupting current flowing through the switch. The switch is capable of opening under normal current load and closing into high fault currents of such as 12,000 amps, 25,000 amps, or even higher in accordance with standard short circuit ratings.

The contact assembly generally moves in an axial direction. As it moves into or out of contact with the first bushing conductor an arc forms between the contact assembly and the conductor. As discussed in more detail below the arc is quenched by the pressurized insulating gas.

Figure 2:
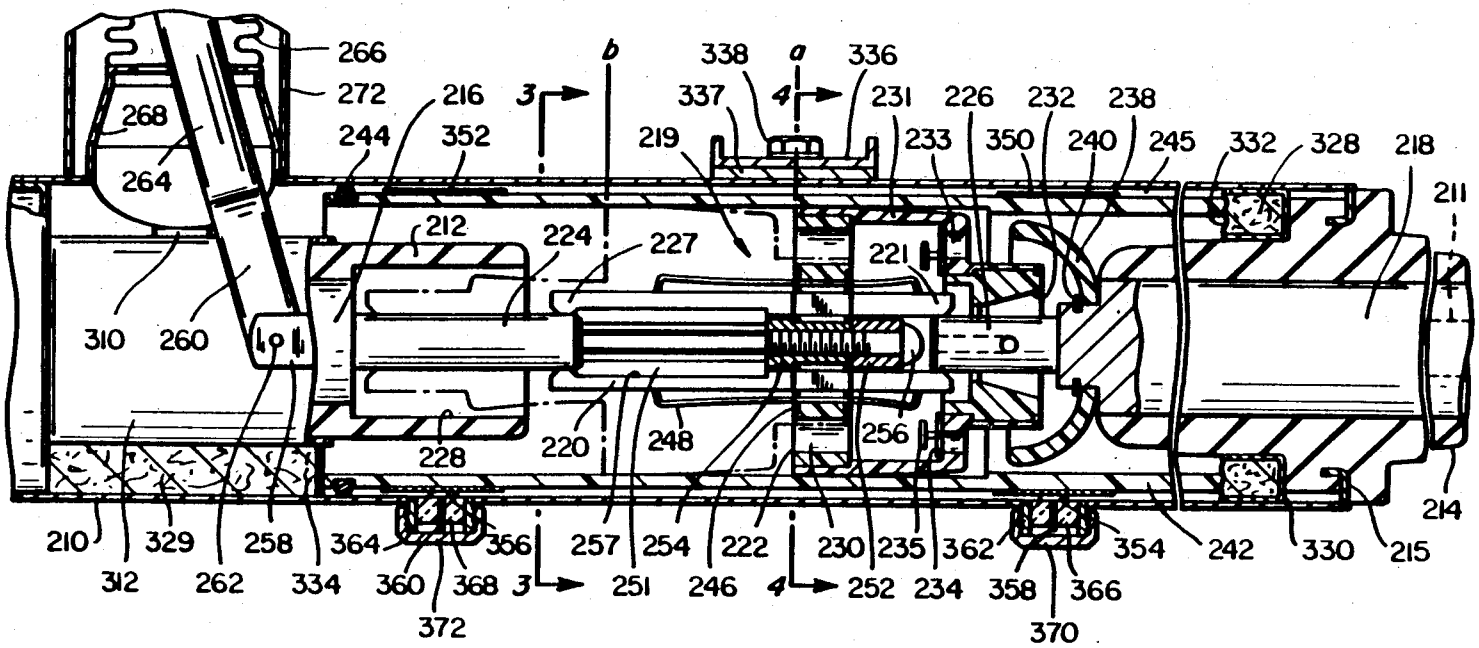
FIG. 2 is a detailed vertical sectional view of the contact assembly portion of the switch of FIG. 1.
Figure 3:
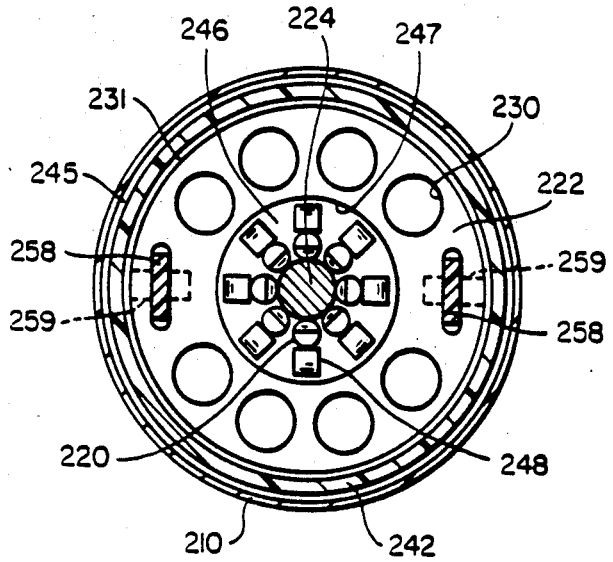
FIG. 3 is a lateral sectional view of the switch of FIG. 1 taken along line 3—3 in FIG. 2.
Figure 4:
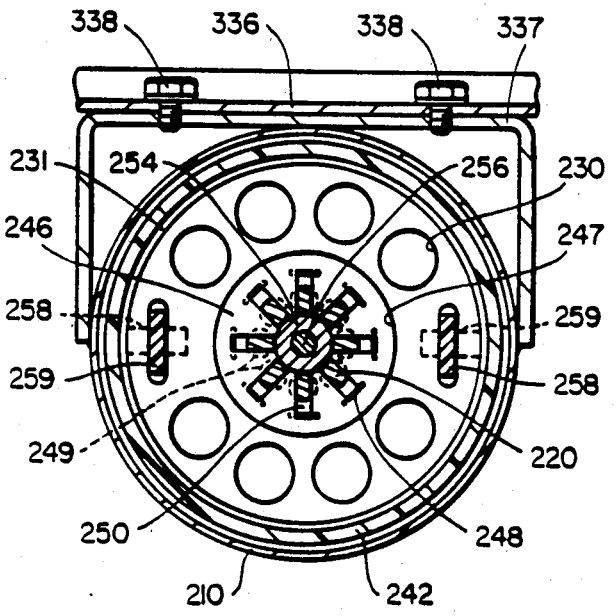
FIG. 4 is another lateral sectional view of the switch of FIG. 1 taken along line 4—4 in FIG. 2.

Preferably the contact assembly comprises a plurality of elongated, electrically conductive contact rods arranged in a hollow cylindrical configuration. The contact rods are preferably of a highly conductive material such as copper. The contact rods are maintained in a cylindrical configuration by being mounted in a holding means providing a radial slot for each rod. The holding means can be an axially slidable piston used for pumping insulating gas as described below, where the piston is made of an insulating material such as molded plastic. The radial slot configuration retains the contact rods in a cylindrical configuration spaced from one another, and notches in the contact rods engage the slots for axial location of the contact rods by the piston. The slots in the holding means can be provided by appropriately configured washers as illustrated in FIGS. 2, 3 and 4 and discussed in more detail below.

The contact assembly is preferably provided with a guide for maintaining the contact assembly in proper axial alignment with the other components. This guide can be a cylinder for the piston.

The piston preferably has a relatively open spider configuration to allow the insulating medium to circulate in the housing. The housing can contain a puffer assembly, for example in a gas insulated interruptor device, to force a flow of arc quenching gas across the gap formed between the first conductor and the contact assembly when the circuit is opened or closed. A puffer device can be conveniently incorporated into the design of the piston, if desired. The piston comprises a relatively solid cylindrical block having a number of holes or passageways drilled through it. When the contact assembly is moved from its first to its second position the insulating gas is forced through the holes and directed to the gap formed between the first electrode and the contact assembly. In such embodiments of the invention the conductive rods of the contact assembly can be mounted on the aligning means so that the surfaces of the rods in contact with the first electrode are positioned relatively close to the holes through the aligning means.

The contact assembly comprises a spring associated with the contact rods such that when the assembly is in its first position, that is in contact with each of the conductors, the contact rods exert a maximum inward contact force on the conductors. This assures low contact resistance and high heat transfer across the closed contacts. The springs can be, for example, leaf springs mounted on each of the conducting rods. Other springs such as a spiral or garter spring mounted around the conducting rod assembly, individual radial springs mounted on each rod, or any other means which provides an inward force on the conducting rods can be used.

To open the switch the contact assembly is moved from the first to the second position, that is the piston is moved so that the contact rods no longer contact both conductors. The assembly can be moved by means of a linking arrangement connected with the piston which is activated by a handle or actuator located external to the housing. As described more fully below with reference to the accompanying drawings, opening of the switch, that is moving the switch to its second position, causes the contact rods to move away from the first electrode. An arc between the leading edges of the contact rods is extinguished by the insulating gas. The inward force applied to the contact rods causes the rods to be pushed inward against a spacer as soon as the contact rods are no longer in contact with the first conductor. The spring is associated with the contact rods in such a manner that when the contact rods are forced inwardly against the spacer upon disengagement with the first conductor, the force on the opposing ends of the contact rods against the second conductor is greatly reduced. The contact rods remain in contact with the second conductor so that current resulting from the arc between the leading edge of the rods and the first conductor is transferred to the second conductor. The contact assembly is drawn away from the first conductor a sufficient distance to provide a gap such that the arc between the first conductor and the contact rods does not regenerate after it has been quenched. The reduced force on the rods at this end of the assembly reduces wear on the rods and the second conductor.

Generally, it has been found that when the contact assembly is used in a load-break switch in a 200 ampere, 15 kV circuit, the piston can have a relatively open "spider" configuration. When used in a 600 ampere, 15 kV circuit a puffing mechanism is preferably provided.

For the puffing mechanism to be effective, the flow of insulating gas must continue after the contacts have separated a distance sufficient to prevent regeneration of the arc until a subsequent current reversal occurs. Because synchronization of contact opening with line frequency is not practical, the flow of quenching gas must continue for at least half a cycle to insure quenching flow after the contacts have separated beyond the arc regeneration distance. Because it is also desired to minimize the heat generated by the arc, quenching should be completed within a short time interval. The switch of the present invention can be operated with a short contact stroke with corresponding low contact velocity within a time frame dictated by the above considerations. Since the low contact velocity greatly reduces the kinetic energy necessary for operating the switch, light weight construction of the moving parts is possible, so that a very low power actuator can be used.

By making all of the components other than the contact assembly of an appropriate insulating medium, it is possible to produce a ground enclosed compact switch in which the ground enclosure is less than 6 inches in diameter.

A piston operating in a cylinder can guide the contact assembly in versions of the invention in which a puffer or gas blasting mechanism is employed. A puffer mechanism provides a flow of insulating gas to the region where the arc forms to "blow out" the arc. In such versions, the body of the piston is relatively solid and is provided with appro-priately positioned holes extending through the piston to direct a flow of insulating gas to the gap between the contacts so as to quench the arc formed as the contact assembly is moved. A puffer mechanism used in an embodiment of this invention is illustrated in FIG. 2 discussed in more detail below.

It is preferred to insert a solid tubular member or liner of an appropriate insulating medium or material between the contact assembly and the housing in the vicinity of the arcing zone. The tubular member preferably is positioned adjacent the wall of the housing and if desired can be bonded thereto. If the tubular member is bonded to the metal wall, the interface between the two components should be void free. It is preferred to position the tubular member such that there is an annular gap between the member and the wall. The tubular member can extend the entire length of the housing, if desired. The thickness of the insulating material depends, to a certain extent, on the voltage use of the switch. In general the tubular member should be from about 0.1 inch (2.5 mm) to about 0.5 inch (13 mm) thick. The tubular member is preferably of an acrylic, epoxy, or similar plastic. The tubular member can serve as a cylinder for guiding the piston of the contact assembly.

The switch can be equipped with electrodes for capacitive detection at relatively low voltage both high voltage energization of the switch conductors and the open or closed position of the contacts. This is possible with the tubular insulating liner positioned coaxially within the housing separated therefrom by a small gap or annular space for capacitive division of alternating current voltages of the conductors. The insulating liner can have conductive bands deposited in contact with the annular space, axially positioned proximate to each coaxial contact. The conductive bands can be connected to hermetically sealed terminals on the housing. Voltage measurements of the terminals can be made locally or remotely, the measurements corresponding to the contact voltages when the switch is connected in a distribution system.

For example, if the housing is approximately three inches (76 mm) in diameter, the conductive bands are approximately 2.9 inches (74 mm) in diameter and the contacts are approximately 0.5 inches (13 mm) in diameter, a voltage of 15 kV at either contact results in a voltage of approximately 225 volts being coupled to the corresponding conductive band; therefore, the presence of a high voltage at either contact can be detected by conventional equipment connected to the corresponding terminals. Should the voltages measured at the terminals indicate that one contact is energized while the other is not, a further indication of the contact assembly being in the open position is provided.

In case the contacts are shown by these measurements to be in the same condition (both energized or both unenergized) a high frequency current source can be connected to one of the terminals to determine the position of the contact assembly. The high frequency excitation of one conductive band is coupled to the corresponding conductor, through the contact assembly to the other conductor, thence to the other conductive band where it can be measured by a conventional frequency discriminating voltmeter. When the contacts are in the closed position, the transfer of excitation from one conductor to the other is direct; however, when the contacts are in the open position the resulting very low series capacitance between the conductors prevents significant high frequency excitation from being passed to the other conductor thence to the other conductive band. The degree of high frequency coupling can be measured under controlled operating conditions for calibration of the measurements. These measurements are meaningful in the switch of the present invention because the capacitance between the contacts is relatively low compared to the capacitance between the conductive bands and the respective contacts.

The switch is provided with means for moving the contact assembly from its first position to its second position. A preferred means comprises a rocking bellows or diaphragm mechanism positioned on the side wall towards one end of the housing. Operation of a lever or arm extending through the bellows results in moving the contact assembly from its first to its second position and back again as desired. Operation of the arm deflects the bellows by lateral and/or pivoting motion in a direction substantially normal to the axis of expansion of the bellows. This mode of deflection of the bellows is referred to herein as "rocking".

The use of bellows having rocking mode deflection in the high voltage switch provides several advantages. The rocking bellows can be operated without substantially changing the volume enclosed by the bellows as the contact assembly moves from its first position to its second position. This eliminates work which otherwise would be done compressing the insulating gas by conventional axial movement of the bellows. The rocking bellows enables the bellows to be located off the center line axis and thereby permits the unimpeded linear orientation of the conductors. Such linear orientation of the conductors, made possible by the use of a rocking bellows in this manner, permits the switch to be readily installed as discussed more fully below. Further, the linear orientation of the conducting path within the switch assembly advantageously affects the magnitude and direction of magnetic forces arising from a short circuit. The metal enclosure provides useful shielding tending to reduce the magnetic forces resulting from external current loops under short circuit conditions.

The use of a rocking bellows adds to the long life of the switch since there are no gas leak paths that would be present if O-ring or sliding seals were used.

Use of the rocking bellows reduces the size and cost of the bellows required, that is, the number of convolutions required of the bellows and also the life of the bellows is also improved because its actuating velocity is reduced, that is, only the relatively small velocities near the pivot are imparted to the bellows and not the high contact velocity. Since the stresses in the bellows are directly related to the velocity to which it is operated at high speeds, this innovation reduces stresses and increases the life and reliability of the device.

The rocking bellows can also be used to operate a safety interlock by axial deflection in case of abnormal pressure within the switch. A low pressure bias can be applied in opposition to the pressure within the housing to compress the bellows, should the pressure within the housing fall too low. The term "compress", used in this context, means that the volume of gas within the switch enclosed by the bellows is reduced, whether the bellows is mounted as shown in the drawings or is inverted. Conversely, "expand" is the opposite of "compress". A high pressure bias can be applied in opposition to the pressure within the housing to allow the bellows to expand should the pressure within the housing become too high. Over the normal range of pressure within the switch, the bellows can be prevented from expanding or contracting by a suitable stop. The arm can be locked, preventing movement of the contacts, should the bellows be contracted as a result of abnormally low pressure. The bellows can be punctured to release the gas, should the bellows be expanded as a result of abnormally high pressure. The combination of rocking mode deflection for movement of the contacts and axial deflection for safety interlock allows the single bellows to hermetically seal these independent motions without introducing an additional potential source of leakage.

The compact size and light weight of the switch shown in the Figures enables it to be readily inserted into a distribution network. The switch can be connected directly into a power cable, for example by a conventional splice or by conventional separable joints or connectors. Such separable joints and connectors are typically of a molded elastomeric material adapted to receive, for example, a power cable and bushing to form an electrical connection between them. The relative ease with which the switch can be inserted in the distribution network is illustrated by the fact that the switch can be attached directly to a transformer by means of an elbow connector. Elbow connectors are commercially available and an example of a typical elbow connector can be found in U.S. Pat. No. 3,559,141 to Hardy.

Referring now to FIGS. 1–5, there is illustrated a preferred version of a switch 205 according to this invention. The switch 205 includes a metal, cylindrical housing 210 at ground potential. A supply bushing 212 and a load bushing 214 are mounted at opposite ends of the housing. The bushings 212 and 214 each have a ring 215 molded in place. The rings 215 are welded to the housing 210 to form a hermetic seal between the supply bushing 212, the load bushing 214 and the housing 210. A supply current rod 216 extends through the supply bushing 212 and a load current rod 218 extends through the load bushing 214. The current rods 216 and 218 each have a threaded hole 211 for engaging a fitting (not shown) or for use as a solder cup to join a power cable 217 of an external distribution network.

With reference to FIGS. 2, 3, and 4, a contact assembly 219 is axially slidably mounted within the housing 210. The contact assembly 219 comprises a plurality of cylindrically disposed contact rods 220 mounted concentrically within a piston 222. When the piston 222 is in a closed position (a) a first end 221 of the contact rods 220 engages an arcing contact 226, which is fastened to the load current rod 218. The contact rods 220 disengage from the arcing contact 226 when the piston is in an open position (b). In the drawings, the parts are shown in the closed position by solid lines; the open position is shown by phantom lines. A second end 227 of the contact rods 220 is at all times slidably engaged with a transfer contact 224, which is fastened to the supply current rod 216 within a counterbore 228 in the supply bushing 212. The counterbore 228 permits the combination of the contact 224 and the supply bushing 212 within the housing 210 to be made shorter for improved heat conduction while maintaining a sufficiently great surface distance over the supply bushing 212 to prevent arcing from the transfer contact 224 to ground potential. The piston 222 is provided with a plurality of axial holes 230 therethrough, to accommodate flow of insulating gas produced by the displacement of the gas by motion of the piston 222 between the first and second positions. A piston cup 231 is fastened to the outside of the piston 222 and holds a nozzle 232 surrounding the arcing contact 226 when the piston is in the first position. The piston cup 231 has a plurality of axial holes 233 all covered by a check valve 234 to control the flow of gas as described below. The check valve 234 is retained by a valve pin 235.

A blast shield 238 is located on the load current rod 218 and held in place by a retaining ring 240. The blast shield 238 is concave toward the arcing contact 226 for protecting the load bushing 214 from arcing.

An insulating liner 242 surrounding the contact assembly 219 is radially centered within the housing 210 by an 0-ring 244 proximate to the supply bushing 212 to provide an annular space 245 between the housing 210 and the insulating liner 242. The piston cup 231 with the piston 222 is guided by the inside of the insulating liner 242.

The contact rods 220 are aligned to the piston 222 by a pair of finger washers 246, which are centered in counterbores 247 on opposite sides of the piston. Each of the contact rods 220 is biased inwardly by a leaf spring 248. Each of the contact rods 220 and leaf springs 248 have notches 249 to engage a slot 250 in the finger washers 246. A sleeve spacer 252 is clamped to a threaded spacer 254 by a screw 256. The spacers 252 and 254 are axially located by engagement of the finger washers 246 with the spacers 252 and 254 within a cylinder 251 formed by the contact rods 220.

The main purpose of the sleeve spacer 252 is to control the contact force between the contact rods 220 and the transfer contact 224 when the contact rods 220 are disengaged from the arcing contact 226. When the contact rods disengage from the arcing contact, the contact rods are driven against the sleeve spacer 252 by the leaf springs 248. The shift in the axial position of the reaction force against the contact rods from the arcing contact 226 to the sleeve spacer 252 results in reduction in the force of the contact rods on the transfer contact 224, thereby reducing the magnetude of the contact force at the transfer contact when the contact rods 220 are disengaged from the arcing contact 226. The amount of this outward bias depends on the length of the sleeve spacer 252. A relief 257 is provided in each contact rod 220 localizing the pressure on the transfer contact 224 at the end 227 of the contact rod 220. It is acceptable to tolerate a much lower contact force on the transfer contact 224, because heating is not a problem within the very short time interval that is required to move the contacts from their open to closed position, i.e. a matter of 10 to 20 milliseconds. Another purpose of the spacers 252 and 254 is to retain the contact rods 220 and the leaf springs 248 within the slots 250 to facilitate handling of the contact assembly 219 prior to final assembly within the housing 210.

Preferably clearance is provided between the sleeve spacer 252 and the contact rods 220, the clearance being sufficient to allow for some misalignment of the arcing contact 226 with the contact assembly 219 and for normal erosion of the contacts.

The piston 222 is driven from the open position (a) to the closed position (b) by a pair of links 258, which are pivotably connected to the piston by a pair of piston pins 259. The piston pins 259 can also serve to fasten the piston cup 231 to the piston 222.

Preferably the piston 222, the cup 231, the links 258 and the piston pins 259 are all made of an insulating material. By avoiding the use of unnecessary conducting materials in the vicinity of the contact assembly 219, the grounded housing 210 can be smaller in diameter without being subjected to arcing. Conductive materials within the contact assembly 219 are arranged within a diameter approximating the diameter of the supply bushing 212 and the load bushing 214 resulting in a nearly optimum ratio of energized to grounded coaxial diameters for reducing the maximum electric field strength within the housing 210. In addition, the use of only insulating materials where there is sliding contact, especially between the piston cup 231 and the insulating liner 242, avoids contamination of the insulating gas within the switch 205 by conductive wear particles.

Figure 6:
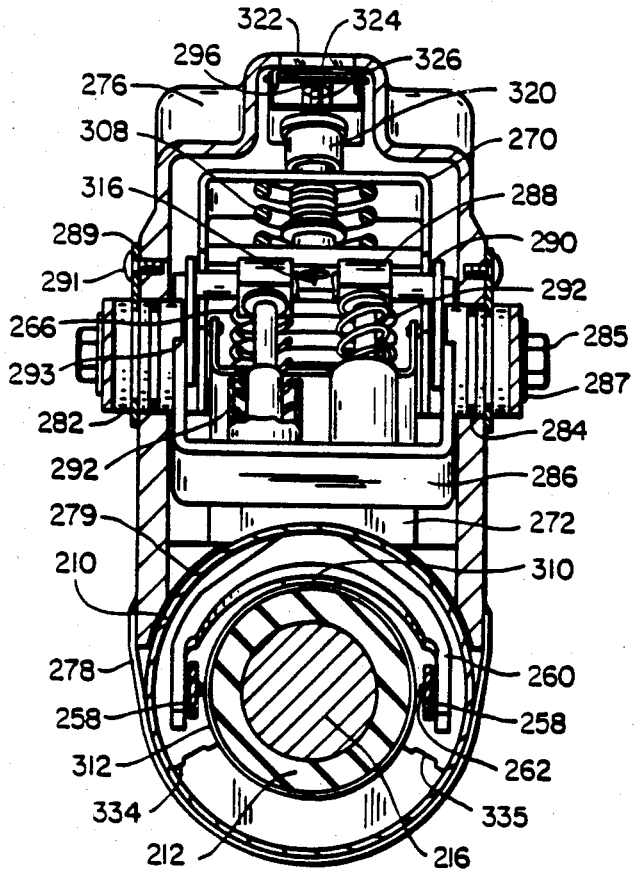
FIG. 6 is a lateral sectional view of the switch of FIG. 1 taken on line 6—6 in FIG. 5.
Figure 5:
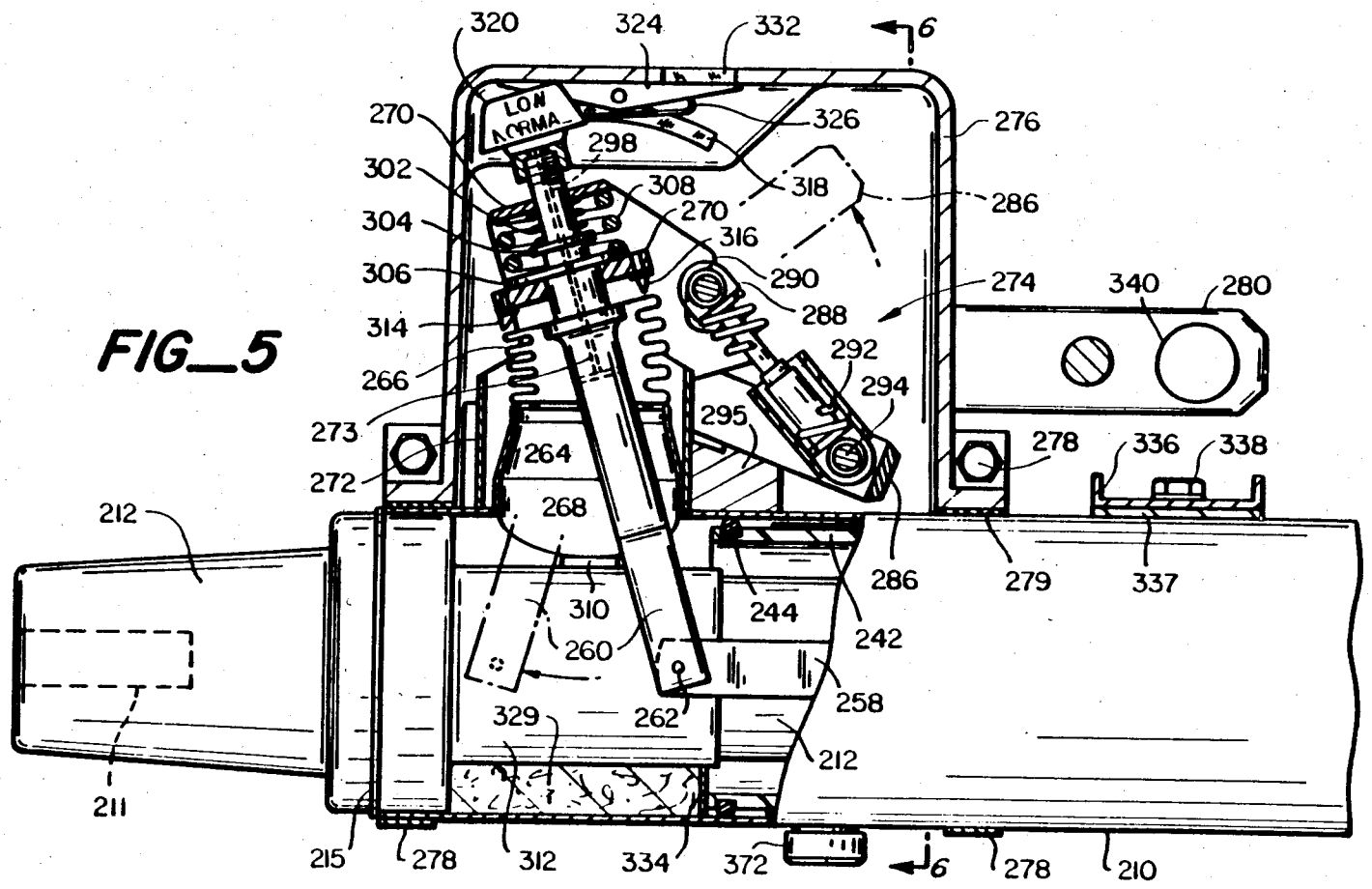
FIG. 5 is a detailed vertical sectional view of the actuator of the switch of FIG. 1, the actuator including a water-tight cover.

With reference to FIGS. 5 and 6, the links 258 are connected to a yoke 260 by a pair of yoke pins 262. A crank or actuating arm 264 is welded to the yoke 260 and extends through a rocking bellows 266, the bellows 266 being soldered to the arm 264 to form a hermetic seal. The bellows 266 is soldered to a bellows support 268, which is welded to the housing 210. The arm 264 slidably engages a bridge rocker 270, which is pivotably mounted to a rocker stand 272 welded to the housing 210. The pivotable mounting of the bridge rocker 270 to the rocker stand 272 forms a fulcrum 273 for the arm 264. The fulcrum 273 passes through the rocking bellows 266 for sufficient freedom of the arm 264 with only slight strain of the rocking bellows 256. Rotation of the crank through an angle of about 32 degrees results in movement of the piston 222 by the links 258 between the closed position (a) and the open position (b).

An overcenter mechanism 274 is used to pivot the bridge rocker 270 to operate the arm 264. The overcenter mechanism 274 can be enclosed within a water-tight cover 276 fastened to the housing 210 by a pair of conventional clamps 278 with a gasket 279 between the cover 276 and the housing 210. A conventional handle 280 straddles the cover 276 and is coupled to the overcenter mechanism 274 through the cover 276 by a pair of coupling shafts 282 equipped with O-ring seals 284.

The gasket 279 and the O-ring seals 284 exclude water and foreign matter from the interior of the cover 276 which is maintained nominally at atmospheric pressure.

The coupling shafts 282 are each fastened to a slot 283 in the handle 280 by a screw 285 and a washer 287. Each of the coupling shafts 282 is held in axial alignment by a coupling retainer 289 fastened to the cover 276 by a screw 291.

The overcenter mechanism 274 comprises a U-shaped detent arm 286 pivotably mounted to the rocker stand 274 in line with and driven by a slot 293 in each of the coupling shafts 282. A striker 288 is pivotably mounted to the rocker stand 272, engaging slots 290 in the bridge rocker 270 and biased by an overcenter spring 292 away from a detent shaft 294, which is fixed to the detent arm 286. The travel of the detent arm 286 and the bridge rocker 270 is limited by a detent stop 295, which is fastened to the rocker stand 272.

In some applications of the switch 205, the watertight cover 276 enclosing the overcenter mechanism 274 need not be provided. In that case, the handle 280 can be adapted to be fastened directly to the detent arm 286 as shown in FIG. 1.

Sulfur hexafluoride, or other insulating gas, is introduced into the switch 205, with the cover 276 removed, through an extension 296 and inlet passage 298 in the crank 264. After the introduction of the desired amount of gas to the switch 205, a hermetic seal is generated by bending the exension 296 to produce a fold 300.

The arm 264 is biased toward the interior of the housing 210 by a low pressure spring 302 acting through a spring washer 304. The elevated pressure within the switch biases the rocking bellows 266 away from the housing 210, compressing the low pressure spring 302 until the arm 264 engages a stop washer 306, which is biased against the bridge rocker 270 by a high pressure spring 308. If a leak develops in the switch, the low pressure spring 302 overcomes the reduced pressure within the rocking bellows 266 to displace the arm 264 toward the supply bushing 212. In that event, the arm 264 is in a locked inoperative position and the piston 222 is locked into either the first or second position by a stop 310 engaging the yoke 260. The stop 310 is fixably mounted to a collar 312 welded to the housing 210, the collar 312 surrounding the supply bushing 212. Normal pressure within the housing 210 causes the yoke 260 to be positioned away from the stop 310 to permit operation of the piston 222 between the first and second positions.

In the event that an abnormally high pressure develops within the housing 210, the outward bias of the rocking bellows 266 overcomes the high pressure spring 308 and the stop washer 306 is forced away from the bridge rocker 270. This causes the rocking bellows 266 to be punctured by a blade 314 and/or a point 316 fixed to the bridge rocker 270. This safety feature prevents an explosion of the switch, should there be an abnormal generation of gas within the switch. Should the rocking bellows 266 become punctured by the blade 314 and/or the point 316, the resulting low pressure condition causes the piston 222 and arm 264 to become locked as before described.

A side window 318 is provided in the cover 276 for visual indication of the pressure within the housing 210. A cap 320 mounted on the arm 264 has colored low and normal indications visible one at a time through the side window 318. When the proper pressure level exists within the housing 210, the "normal" indication is visible through the side window; when a low pressure condition allows the crank to be depressed to lock the yoke by the stop 310 the "low" indication is visible through the side window. If the rocking bellows 266 becomes punctured by the blade 314 or the point 316 as a result of an abnormally high pressure within the switch, the stop 310 becomes engaged by the yoke 260 as a result of the ensuing low pressure condition and the "low" indication will be visible through the side window.

Alternatively, a plurality of indicia of the "normal" and "low" pressure conditions can be provided the indicia simultaneously visible through a window array for increasing the visibility of the indication.

A visual indication of the position of the contact assembly 219 is provided through a top window 322 in the cover 276. A position indicator 324 having appropriate "open" and "closed" labels is connected to the cap 320 and biased against the top window by a clip 326.

Remote indications of pressure and contact position conditions can be provided by means of conventional switches (not shown) which can be actuated by the cap 320 and the position indicator 324 respectively.

A molecular sieve 328 is retained within a holder 330 by a screen 332. The insulating liner 242 holds the screen in place to retain the molecular sieve with the holder against the load bushing 214. The small size of the switch 205 results in a high ratio of surface area to volume within the housing 210; therefore, a substantial concentration of undesirable moisture from the internal surfaces can be present after the switch 205 is sealed. The molecular sieve 328 attracts moisture from within the housing 210 and gas contaminates generated by wear and/or arcing within the switch. The insulating liner 242 is held against the screen by a liner stop 334, which is fastened to the collar 312. An auxilliary molecular sieve 329 can be retained under the collar 312 by a pair of tabs 335 on the liner stop 334.

A bracket 334 is welded to the housing to permit the switch 205 to be located by a channel 336 fastened to the bracket 334 by a pair of screws 338. The channel 336 can be used to support the switch 205 and/or locate additional switches according to this invention parallel to the switch 205, for example, to form an assembly of three single-phase switches. A bar 340 extending through the handles 280 of the switches 205 can operate each of the switches simultaneously to disconnect the phases in a 3-phase configuration. The screws 338 can be used to electrically connect the housing 210 to ground. A shield lead 342 from each of the power cables 217 is clamped under a corresponding screw 338.

The switch 205 is equipped with electrodes for capacitive detection at relatively low voltage both high voltage energization of the switch conductors and the open or closed position of the contacts. The insulating liner has a first conductive band 350 and a second conductive band 352 deposited in contact with the annular space 245 axially positioned proximate to the arcing contact 226 and the transfer contact 224 respectively. On the conductive bands 350 and 352 are soldered corresponding first and second spring clips 354 and 356 engaging first and second terminals 358 and 360. The first and second terminals 358 and 360 are insulatingly hermetically sealed within respective first and second nipples 362 and 364 by corresponding first and second bushing plugs 366 and 368. The first and second nipples 362 and 364 protrude the housing 210 and are hermetically fastened thereto with solder. First and second threaded caps 370 and 372 engaging respective first and second nipples 366 and 368 can be provided for protecting the terminals 358 and 360 when not in use.

Whether used singly or in combination the switch 305 is sufficiently light and compact to be supported by the power cables 217 connected to the supply current rod 216 and the load current rod 218, if desired.

In operation, movement of the handle 280 away from the housing 210 causes the detent arm to rotate, compressing the overcenter spring 292 until the detent arm 286 is in line with the striker 288. Continued operation of the handle results in rapid rotation of the bridge rocker 270 by the striker 288 to generate a snap action of the piston 222 and the contact assembly 219 from (a) the closed position to (b) the open position regardless of the speed of operation of the handle 280. Conversely, movement of the handle 280 toward the housing 210 causes the piston 222 and the contact assembly 219 to snap from (b) the open position to (a) the closed position regardless of the speed of operation of the handle 280.

When the contact assembly 219 snaps from (a) the closed position to (b) the open position, the ends 221 of the contact rods 220 are displaced from contact from the arcing contact 226. This results in an arc being drawn between the contact rods 220 and the arcing contact 226 when a load current is present in the switch 205. The rapid motion of the piston 222 generates a flow of insulating gas through the holes 230 in the piston 222, the gas being directed around the first ends 221 of the contact rods 220 and through the nozzle 232 to quench the arc. The flow of gas increases the pressure within the piston cup 231, holding the check valve 234 closed against the piston cup confining all gas flow to the nozzle 232.

The increased pressure within the piston cup 231 caused by the flow of insulating gas through the nozzle 232 tends to stabilize the velocity of the contact assembly 219 to assure a continued flow of insulating gas through the nozzle 232 during a current reversal following separation of the contact rods 220 from the arcing contact 226 a distance sufficiently great to preclude arc regeneration. The volume of insulating gas downstream of the nozzle 232 within the housing 210, including the volume of the annular space 245, being larger than the remaining volume of insulating gas within the housing 210, provides for expansion of insulating gas having been heated by the arc without excessivly increasing back pressure at the nozzle.

The equalization of gas pressure within the housing 210 downstream of the nozzle 232 and within the annular space 245 causes some flow of insulating gas through the molecular sieve 328. Wear particles and vaporization products present in the insulating gas are directed toward the molecular sieve 328 where they are trapped as a result of gas flow through the molecular sieve 328 and because of the attracting properties of the molecular sieve 328.

Additional wear particles and vaporization products are attracted to the auxilliary molecular sieve 329.

When the switch 205 is operated to connect a load by movement of the contact assembly 219 from (b) the second position to (a) the first position, the check valve 234 opens by sliding on the valve pins 235 away from the holes 233 in the piston cup 231, thereby relieving pressure in front of the advancing piston cup 231 to allow a more rapid snap movement of the contact assembly 219 from (b) the second position to (a) the first position for preventing arcing as the first ends 221 of the contact fingers 220 engage the arcing contact 226.

When the arcing contact 226 or the transfer contact 224 are energized with an alternating current voltage, a corresponding voltage can be measured at the corresponding first or second terminals 358 or 360. A voltage of 15 KV at either the arcing contact 226 or the transfer contact 224 results in a voltage of approximately 225 volts being coupled to the corresponding first or second conductive band 350 or 352, thus the presence of a high voltage at either contact can be detected by conventional equipment connected to the corresponding terminals 358 and 360. Should the voltages measured at the first and second terminals 358 and 360 indicate that one contact is energized while the other is not, a further indication of the contact assembly 219 being in the open position is provided.

In case the arcing contact 226 and the transfer contact 224 are shown by these measurements to be in the same condition (both energized or both unenergized) a high frequency current source can be connected to one of the first or second terminals 358 or 360 to determine the position of the contact assembly 219 as described above.

Although the present invention has been described in considerable detail with reference to certain preferred versions thereof, other versions are possible. Therefore, the spirit and scope of the appended claims should not necessarily be limited to the description of the versions contained herein.

What is claimed is:

1. A switch comprising:

(a) a sealed housing;

(b) a pressurized insulating gas in the housing;

(c) a bellows sealingly mounted to the housing;

(d) an actuating arm having an operative position in which the arm is capable of opening and closing the switch, the actuating arm being sealingly mounted to the bellows and extending into the housing through the bellows;

(e) low pressure biasing means for biasing the bellows in opposition to the gas pressure in the housing, wherein when the force of the gas on the bellows is greater than the force of the low pressure biasing means on the bellows, the arm is in its operative position; and (f) locking means for rendering the arm inoperative, the locking means being positioned so that when the force of the low pressure biasing means on the bellows is greater than the force of the gas on the bellows, the bellows is contracted by the low pressure biasing means and the arm is moved into a locked position.

2. The switch of claim 1 wherein when the arm is in the locked position, the arm cannot be used for closing a switch.

3. The switch of claim 1 wherein when the arm is in the locked position, the arm cannot be used for opening the switch.

4. The switch of claim 1, wherein when the arm is in the locked position, it cannot be used for closing or opening the switch.

5. The switch of claim 1 in which the bellows deflects in rocking mode when the arm is opening and closing the switch.

6. The switch of claim 1 in which the actuating arm is a lever arm.

7. The switch of claim 1 further comprising:

(a) a cover over the actuating arm;

(b) a normal pressure indicia on the arm external of the bellows;

(c) a low pressure indicia on the arm external of the bellows; and (d) a window through the cover for exposing one of the indicia at a time, the normal pressure indicia being visible through the window when the bellows is not contracted by the low pressure biasing means, the low pressure indicia being visible through the window when the bellows is contracted by the low pressure biasing means.

8. The switch of claim 7 in which the low pressure indicia is farther from the bellows than is the normal pressure indicia.

9. The switch of claim 1 further comprising:

(a) high pressure biasing means for biasing the bellows in opposition to gas pressure within the bellows for preventing expansion of the bellows unless the force of the gas on the bellows is greater than the force of the high pressure biasing means on the bellows; and (b) puncture means for piercing the bellows when the bellows expands against the high pressure biasing means.

10. The switch of claim 9 wherein when the bellows is punctured, the gas pressure in the housing decreases so that the arm moves into the locked position.

11. A switch comprising:

(a) a sealed housing;

(b) a pressurized insulating gas in the housing;

(c) a bellows sealingly mounted to the housing;

(d) an actuating arm for opening and closing the switch, the arm being sealingly mounted to the bellows and extending into the housing through the bellows;

(e) high pressure biasing means for biasing the bellows in opposition to gas pressure within the bellows for preventing expansion of the bellows unless the gas pressure in the bellows increases above a predetermined high level; and (f) puncture means for piercing the bellows when the bellows expands against the force of the high pressure biasing means.

* * * * *